US009318849B2

(12) United States Patent
Kobayashi

(10) Patent No.: US 9,318,849 B2
(45) Date of Patent: Apr. 19, 2016

(54) SHIELDED CONNECTOR

(71) Applicant: Yazaki Corporation, Minato-ku (JP)

(72) Inventor: Masaki Kobayashi, Kakegawa (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 14/474,984

(22) Filed: Sep. 2, 2014

(65) Prior Publication Data

US 2014/0370753 A1 Dec. 18, 2014

Related U.S. Application Data

(63) Continuation of application No. 14/110,754, filed as application No. PCT/JP2012/060183 on Apr. 13, 2012, now abandoned.

(30) Foreign Application Priority Data

Apr. 14, 2011 (JP) ..... 2011-090410

(51) Int. Cl.
*H01R 13/6593* (2011.01)
*H01R 13/52* (2006.01)
*H01R 13/74* (2006.01)

(52) U.S. Cl.
CPC ..... *H01R 13/6593* (2013.01); *H01R 13/5205* (2013.01); *H01R 13/5216* (2013.01); *H01R 13/748* (2013.01)

(58) Field of Classification Search
CPC ..... H01R 13/6593
See application file for complete search history.

(56) References Cited

U.S. PATENT DOCUMENTS 4,010,315 A 3/1977 Mildner
4,822,304 A * 4/1989 Herron ..... H01R 13/6485 439/607.57
4,887,971 A * 12/1989 Reuss ..... H01R 13/6592 439/98
5,401,177 A * 3/1995 Dutton ..... H01R 13/6593 439/905
6,583,352 B2 * 6/2003 Fukushima ..... H01R 9/032 174/373
6,781,059 B2 * 8/2004 Mizutani ..... H01R 13/6592 174/75 C
6,815,610 B2 * 11/2004 Kuboshima ..... H01R 9/032 174/360
6,837,728 B2 * 1/2005 Miyazaki ..... H01R 9/032 439/271

(Continued)

FOREIGN PATENT DOCUMENTS

DE 4322232 A1 1/1995
EP 2254199 A1 11/2010

(Continued)

OTHER PUBLICATIONS

Communication issued on Feb. 12, 2015 by the Korean Intellectual Property Office in related application 1020137026954.
International Preliminary Report on Patentability, dated Oct. 24, 2013, issued by the International Searching Authority in counterpart International Application No. PCT/JP2012/060183.

(Continued)

*Primary Examiner* — Ross Gushi
(74) *Attorney, Agent, or Firm* — Sughrue Mion, PLLC

(57) ABSTRACT

The male shielded connector of the invention includes terminals which are connected to end portions of electric wires, a housing which contains the terminals, a shield shell which covers the housing, a braided conductor which is externally provided to the wire and is covered on the shield shell, and a shield ring which is swaged to the outer circumference of the braided conductor to fix the braided conductor in a state that the braided conductor is electrically connected to the shield shell, the shield ring being made of a metal material. An insulation layer is provided between the braided conductor and the shield ring.

1 Claim, 5 Drawing Sheets

(56) References Cited

U.S. PATENT DOCUMENTS 6,864,426 B2 * 3/2005 Miyazaki ..... H01R 13/655 174/75 C
6,921,292 B2 * 7/2005 Miyazaki ..... H01R 9/032 439/564
7,041,907 B2 * 5/2006 Miyazaki ..... H01R 13/6592 174/359
7,064,266 B2 * 6/2006 Wada ..... H01R 13/6592 174/359
7,094,970 B2 * 8/2006 Kihira ..... B60L 11/1803 174/74 R
7,101,217 B2 * 9/2006 Hayashi ..... H01R 13/6592 439/447
7,147,513 B2 * 12/2006 Wada ..... H01R 9/032 439/578
7,189,117 B2 * 3/2007 Kawamura ..... H01R 9/032 439/607.48
7,226,317 B2 * 6/2007 Wada ..... H01R 9/032 439/607.41
7,331,823 B2 * 2/2008 Fukushima ..... H01R 9/032 439/607.46
7,344,413 B2 * 3/2008 Nishida ..... H01R 9/032 439/607.41
7,491,071 B2 * 2/2009 Hamai ..... H01R 9/0527 439/882
7,534,138 B1 * 5/2009 Gump ..... H01R 9/032 439/564
7,597,589 B2 * 10/2009 Kawamura ..... H01R 9/032 439/595
7,614,910 B2 * 11/2009 Croteau ..... H01R 13/512 439/559
7,628,650 B2 * 12/2009 Aoki ..... H02G 3/0683 439/607.28
7,666,032 B2 * 2/2010 Aoki ..... H01R 9/032 29/844
7,674,972 B2 * 3/2010 Gladd ..... H01R 13/658 174/34
7,736,181 B1 6/2010 Benevento et al.
7,749,025 B2 * 7/2010 Aoki ..... H01R 9/032 439/607.41
7,909,647 B2 * 3/2011 Kawaguchi ..... H01R 9/035 439/585
7,959,468 B2 * 6/2011 Yong ..... H01R 13/648 439/607.41
7,988,475 B2 * 8/2011 Sakakura ..... H01R 9/032 439/271
8,167,653 B2 * 5/2012 Hasegawa ..... H01R 13/74 439/607.41
8,191,250 B2 * 6/2012 Kawase ..... H01R 9/0509 174/75 C
8,342,880 B2 * 1/2013 Kato ..... H01R 9/032 439/382
8,408,943 B2 * 4/2013 Okamoto ..... H01R 13/6593 439/607.41
8,425,240 B2 * 4/2013 Lee ..... H01R 13/6593 439/607.41
8,460,015 B2 * 6/2013 Deno ..... H01R 9/0518 174/78
8,562,377 B2 * 10/2013 Kawamura ..... H01R 9/032 439/607.44
8,562,381 B2 * 10/2013 Kawamura ..... H01R 11/12 439/801
8,602,797 B2 * 12/2013 Omae ..... H01R 13/6592 439/99
8,637,770 B2 * 1/2014 Adachi ..... B60R 16/0222 174/74 R
8,641,441 B2 * 2/2014 Aoki ..... H01R 13/415 439/345
8,790,137 B2 * 7/2014 Deno ..... H01R 13/648 439/607.41
8,803,006 B2 * 8/2014 Imahori ..... H01R 9/032 174/539
8,895,875 B2 * 11/2014 Kato ..... H02G 3/0462 174/359
8,946,553 B2 * 2/2015 Kawase ..... H01R 9/0509 174/74 R
8,956,189 B2 * 2/2015 Imahori ..... H01R 4/10 439/587
8,992,249 B2 * 3/2015 Kobayashi ..... H01R 13/6591 439/362
9,017,110 B2 * 4/2015 Guillanton ..... H01R 9/0503 174/34
9,022,794 B2 * 5/2015 Wang ..... H01R 13/5202 439/271
9,039,450 B2 * 5/2015 Germ ..... H01R 9/032 439/607.41
9,059,534 B2 * 6/2015 Endo ..... H01R 13/52
2002/0048994 A1 * 4/2002 Oota ..... H01R 13/5205 439/98
2002/0157843 A1 10/2002 Fukushima et al.
2003/0221850 A1 * 12/2003 Mizutani ..... H01R 13/6592 174/36
2004/0057187 A1 * 3/2004 Kuboshima ..... H01R 9/032 361/118
2004/0099427 A1 * 5/2004 Kihira ..... B60L 11/1803 174/359
2004/0099428 A1 * 5/2004 Miyazaki ..... H01R 13/655 174/366
2005/0266729 A1 * 12/2005 Fukushima ..... H01R 9/032 439/607.46
2007/0021006 A1 * 1/2007 Kawamura ..... H01R 9/032 439/607.48
2009/0093159 A1 4/2009 Aoki et al.
2009/0098779 A1 * 4/2009 Kawamura ..... H01R 9/032 439/733.1
2009/0126985 A1 * 5/2009 Aoki ..... H02G 3/0683 174/377
2009/0260232 A1 10/2009 Aoki et al.
2010/0000788 A1 * 1/2010 Kawase ..... H01R 9/0509 174/74 R
2010/0041271 A1 2/2010 Van Swearingen et al.
2010/0178805 A1 * 7/2010 Yong ..... H01R 13/648 439/607.41
2010/0216323 A1 * 8/2010 Kawamura ..... H01R 13/6593 439/95
2010/0261363 A1 * 10/2010 Sakakura ..... H01R 4/34 439/271
2010/0261364 A1 * 10/2010 Matsuoka ..... H01R 13/5202 439/271
2011/0003507 A1 1/2011 Van Swearingen et al.
2011/0086548 A1 * 4/2011 Wu ..... H01R 9/032 439/607.41
2011/0308855 A1 12/2011 Marsh et al.
2011/0316372 A1 * 12/2011 Kobayashi ..... H01R 9/24 310/71
2011/0316373 A1 * 12/2011 Kobayashi ..... H01R 9/24 310/71
2012/0058674 A1 * 3/2012 Deno ..... H01R 9/0518 439/607.52
2012/0142214 A1 * 6/2012 Kawamura ..... H01R 11/12 439/571
2013/0017719 A1 * 1/2013 Tanaka ..... H01R 9/032 439/587
2013/0056256 A1 * 3/2013 Guillanton ..... H01R 9/0503 174/359
2013/0084728 A1 * 4/2013 Omae ..... H01R 4/646 439/271
2013/0260585 A1 * 10/2013 Wang ..... H01R 13/5202 439/271
2014/0011401 A1 * 1/2014 Endo ..... H01R 13/52 439/588
2014/0038459 A1 * 2/2014 Kobayashi ..... H01R 9/032 439/607.41
2014/0106588 A1 * 4/2014 Suzuki ..... H01R 13/5219 439/271
2014/0179161 A1 * 6/2014 Imahori ..... H01R 13/6592 439/607.45
2014/0209377 A1 * 7/2014 Wang ..... H02G 15/013 174/658

(56) References Cited

U.S. PATENT DOCUMENTS

| | | | | |
|---|---|---|---|---|
| 2014/0235104 | A1* | 8/2014 | Wang | H01R 13/648 439/607.41 |
| 2014/0287631 | A1* | 9/2014 | Tashiro | H01R 13/521 439/733.1 |
| 2014/0370753 | A1* | 12/2014 | Kobayashi | H01R 13/5205 439/607.41 |

FOREIGN PATENT DOCUMENTS

| | | | |
|---|---|---|---|
| JP | 2001-273955 | A | 10/2001 |
| JP | 2002-281654 | A | 9/2002 |
| JP | 2002-324627 | A | 11/2002 |
| JP | 2005-339933 | A | 12/2005 |
| JP | 2008-288020 | A | 11/2008 |
| JP | 2009-87902 | A | 4/2009 |
| JP | 2011-60765 | A | 3/2011 |
| JP | 2012164688 | A | 8/2012 |

OTHER PUBLICATIONS

International Search Report for PCT/JP2012/060183 dated Jul. 10, 2012 (PCT/ISA/210).

Written Opinion for PCT/JP2012/060183 dated Jul. 10, 2012 (PCT/ISA/237).

Office Action dated Apr. 16, 2015, issued by the State Intellectual Property Office of the People's Republic of China in counterpart Chinese Application No. 201280018095.9.

Office Action dated Nov. 18, 2014, issued by the Japanese Intellectual Property Office in counterpart Japanese Application No. 2011-090410.

Search Report dated Jul. 29, 2014, issued by the European Patent Office in counterpart European Application No. 12771781.7.

Office Action dated Dec. 11, 2015, issued by the State Intellectual Property Office of the People's Republic of China in counterpart Chinese Application No. 201280018095.9.

Communication issued on Feb. 9, 2016 by the European Patent Office in counterpart European Application No. 12771781.7.

* cited by examiner

SHIELDED CONNECTOR

CROSS REFERENCE TO RELATED APPLICATIONS

This is a Continuation application of U.S. application Ser. No. 14/110,754, filed Oct. 9, 2013 which is a National Stage Application of PCT application No. PCT/JP2012/060183, which was filed on Apr. 13, 2012 based on Japanese Patent Application (No. 2011-090410) filed on Apr. 14, 2011, the contents of which are incorporated herein by reference.

BACKGROUND

1. Field of the Invention

The present invention relates to a shielded connector in which a braided conductor is fastened and electrically connected to a shield shell by a shield ring.

2. Description of the Related Art

A shielded connector is used as a connector for a wire harness in a hybrid electric vehicle (HEV), an electric vehicle (EV), or the like. A shielded connector includes: terminal-equipped electric wires in each of which a terminal is connected to an end portion of the wire; a housing which contains the terminals of the terminal-equipped wires; a shield shell which is attached to the housing; a braided conductor which is externally attached to the wires; and a shield ring which cooperates with the shield shell to clamp the braided conductor therebetween, and which is swaged to be electrically connectable to the shield shell (see JP-A-2009-87902 and JP-A-2005-339933).

SUMMARY

In a shielded connector in which, as described above, a braided conductor and shield shell are swaged by a shield ring to be electrically conductive with each other, a shielding circuit is formed by connecting the shielded connector to a case, with the result that a shielding effect is attained.

A braided conductor is made of copper or a copper alloy, on the other hand, stainless steel or the like having high strength is used in a shield ring. Therefore, the portion where the braided conductor is in contact with the shield ring has a bimetallic contact, and there is a possibility that galvanic corrosion may occur to reduce the shielding effect.

The invention has been conducted in view of the above-discussed circumstances. It is an object of the invention to provide a shielded connector in which an excellent shielding effect can be always maintained.

In order to attain the above-mentioned object, the shielded connector of the invention is characterized in (1) or (2) below.

(1) A shielded connector comprising:

a terminal which is connected to an end portion of an electric wire;

a housing which contains the terminal;

a shield shell which covers the housing;

a braided conductor which is externally provided to the wire and is covered on the shield shell; and a shield ring which is swaged to an outer circumference of the braided conductor to fix the braided conductor in a state that the braided conductor is electrically connected to the shield shell, the shield ring being made of a metal material, wherein an insulation layer is provided between the braided conductor and the shield ring.

(2) In the shielded connector having the configuration of above (1), wherein the insulation layer is configured by an acetate tape formed of semisynthetic fibers which are made of acetylcellulose.

The shielded connector having the configuration of above (1) is in the state where the shield ring which causes the braided conductor to be in contact and electrically conductive with the shield shell is swaged to the outer circumferential side of the braided conductor through the insulation layer, and the braided conductor and the shield ring are insulated from each other by the insulation layer. Even when the metal of the shield ring is different in kind from that of the braided conductor, therefore, it is possible to surely prevent galvanic corrosion due to a bimetallic contact from occurring in the place where the shield ring is swaged. Consequently, an excellent shielding effect can be always maintained, and high performance and quality can be maintained for a long period.

In the shielded connector having the configuration of above (2), the acetate tape formed of semisynthetic fibers which are made of acetylcellulose is wound around the outer circumference of the braided conductor covered on the shield shell, and the shield ring is swaged from the outer circumferential side thereof. According to the configuration, the braided conductor and the shield ring can be satisfactorily insulated from each other in a very easy manner.

According to the invention, it is possible to provide a shielded connector in which an excellent shielding effect can be always maintained.

In the above, the invention has been briefly described. When a mode for carrying out the invention which will be described below is through read with reference to the accompanying drawings, a detail of the invention will be further clarified.

DETAILED DESCRIPTION OF THE EXEMPLARY EMBODIMENTS

Hereinafter, an embodiment of the invention will be described with reference to the drawings.

Figure 1:
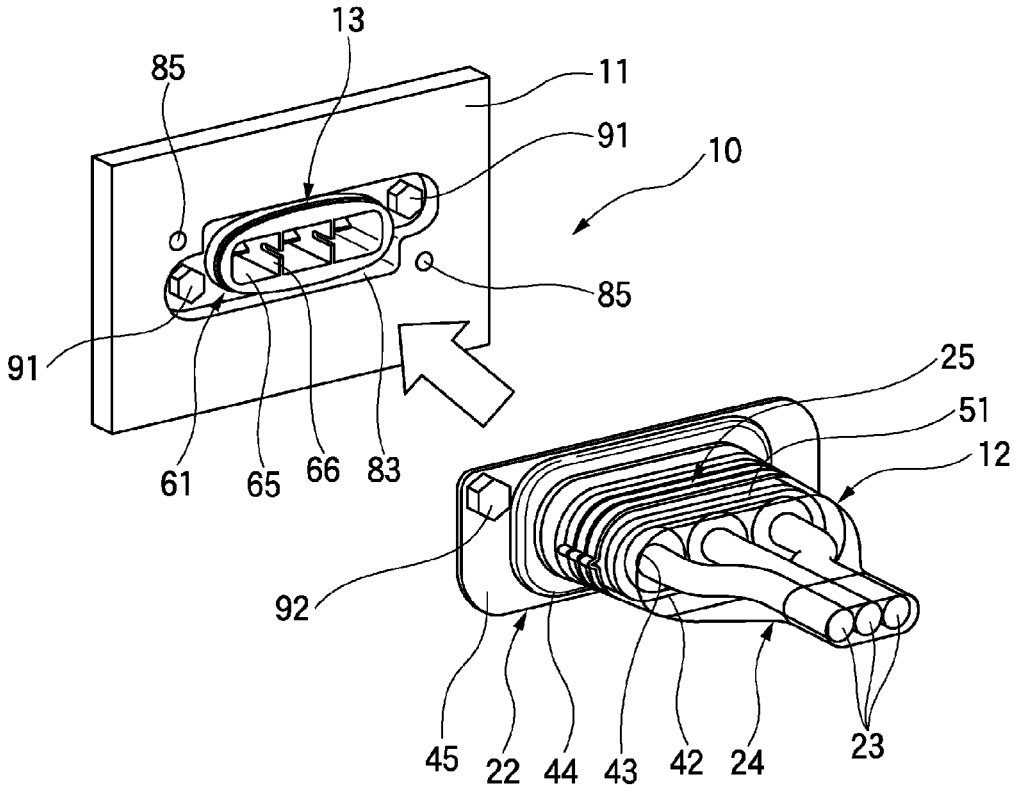
FIG. 1 is a perspective view of a portion where a male shielded connector and a female shielded connector are connected to each other.
Figure 2:
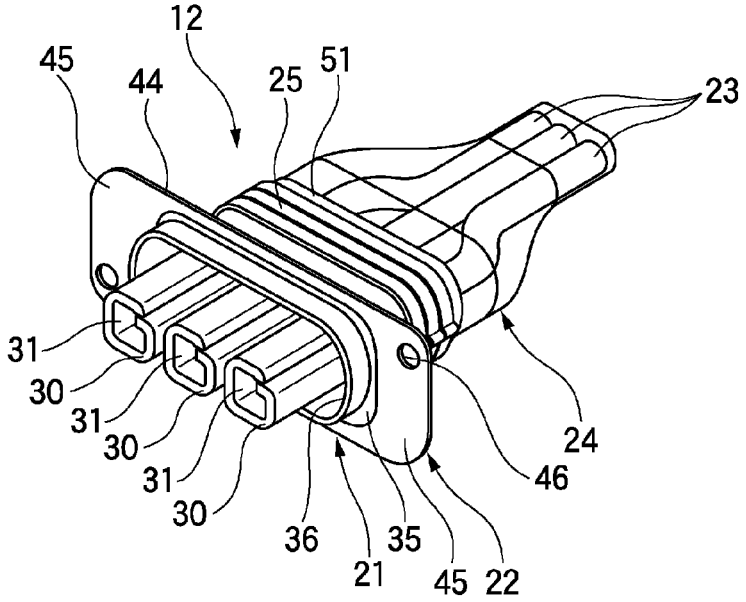
FIG. 2 is a perspective view of a male shielded connector of an embodiment.
Figure 3:
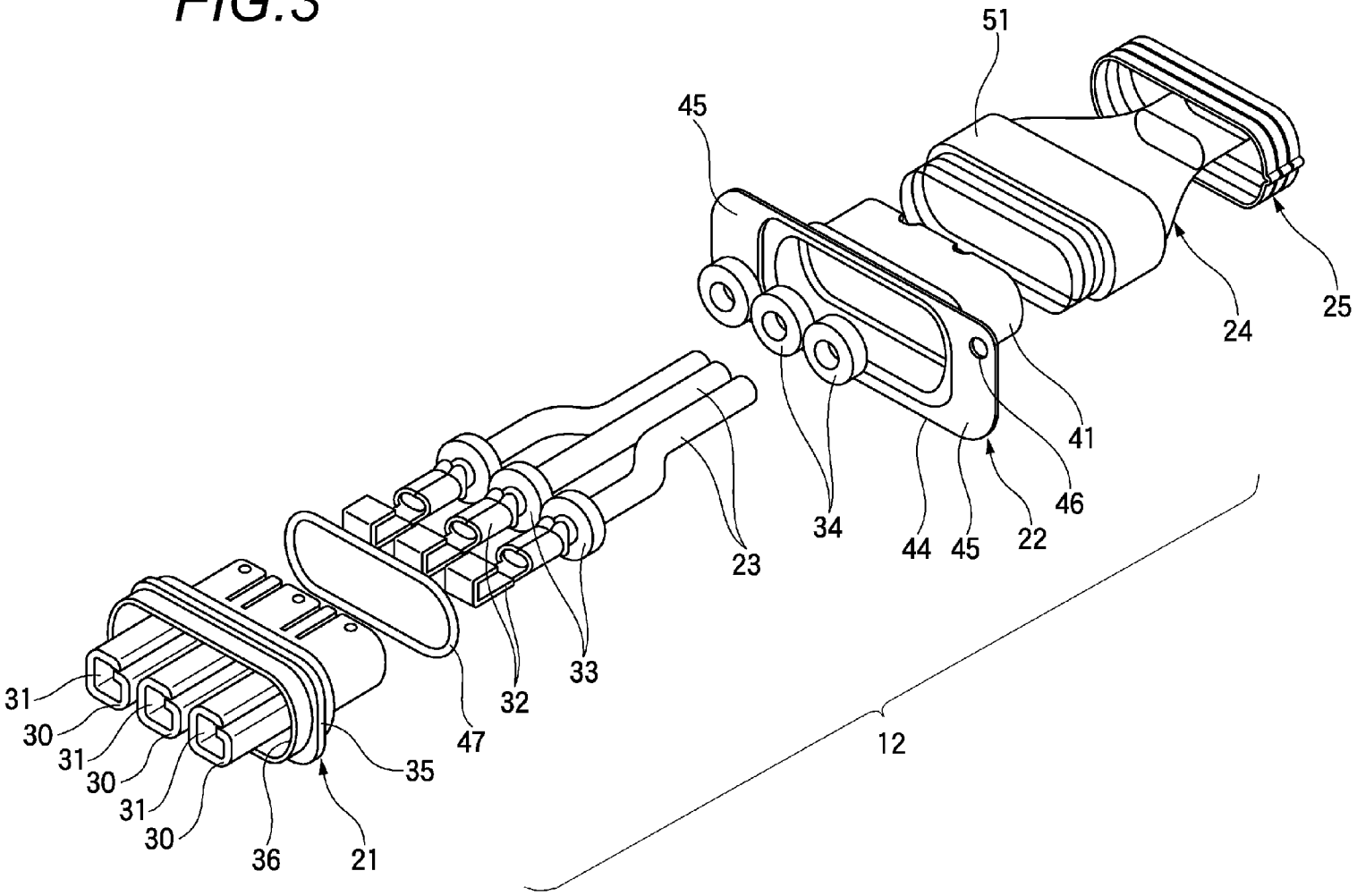
FIG. 3 is an exploded perspective view of the male shielded connector of the embodiment.
Figure 4:
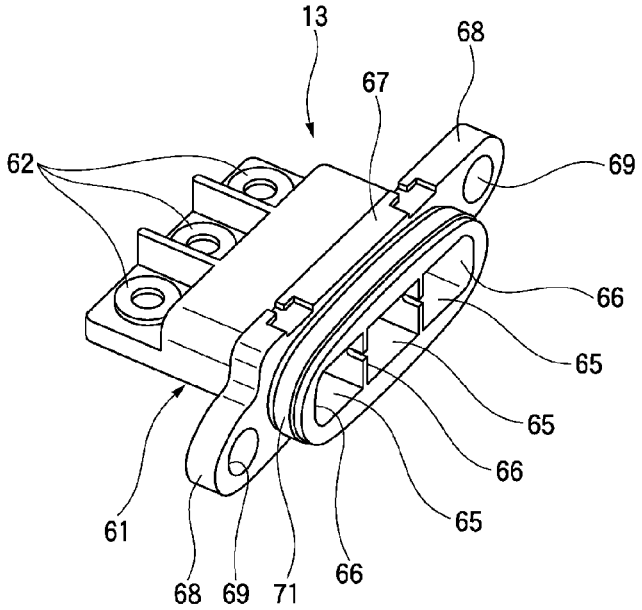
FIG. 4 is a perspective view of the female shielded connector.
Figure 5:
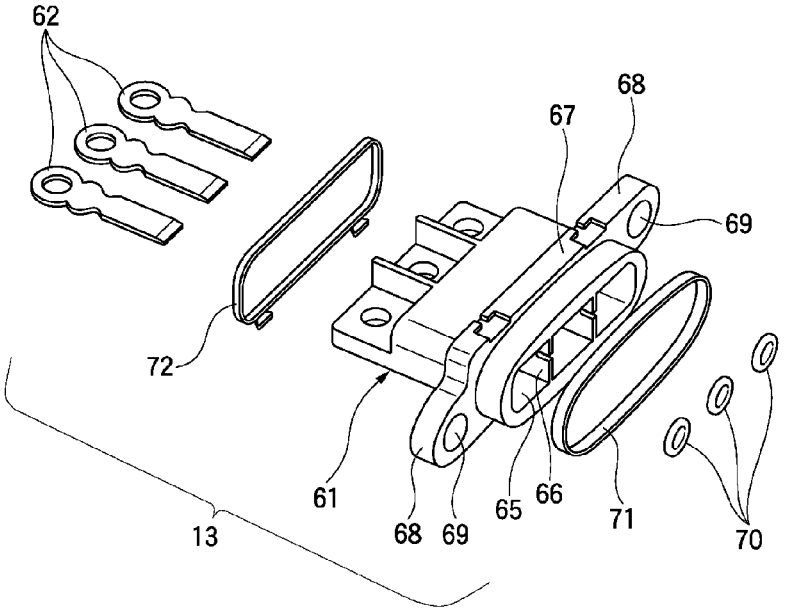
FIG. 5 is an exploded perspective view of the female shielded connector.
Figure 6:
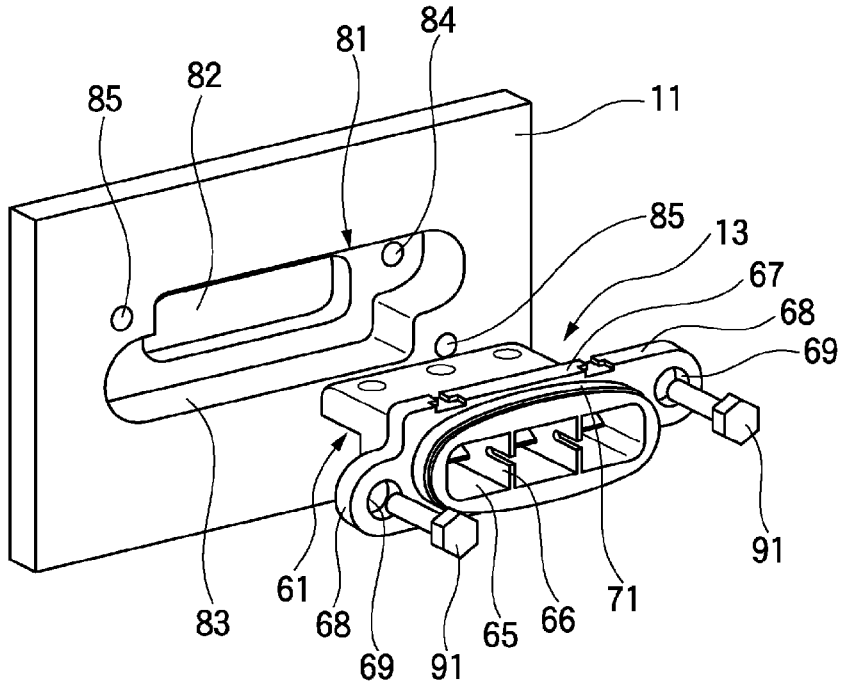
FIG. 6 is a perspective view of a connector attaching portion of a case to which the female shielded connector and the female shielded connector are to be attached.
Figure 7:
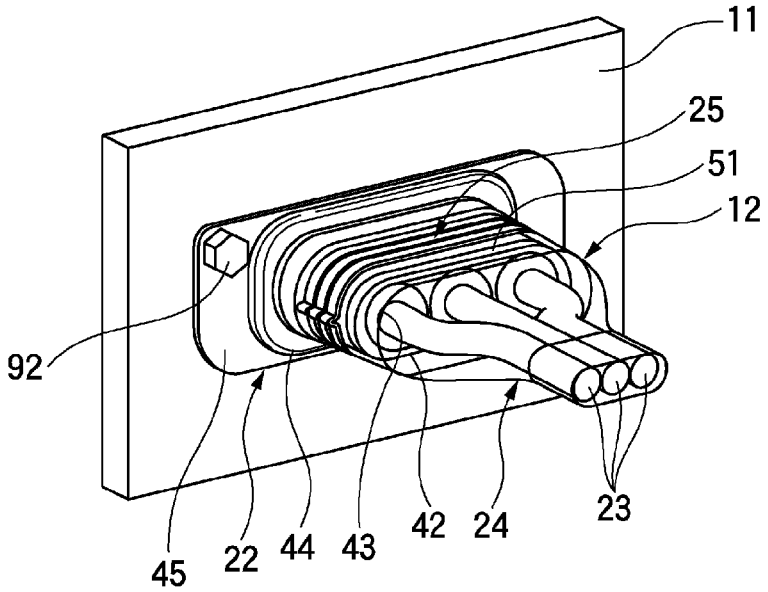
FIG. 7 is a perspective view of the male shielded connector which is connected to the female shielded connector.

FIG. 1 is a perspective view of a portion where a male shielded connector and a female shielded connector are connected to each other, FIG. 2 is a perspective view of a male shielded connector of the embodiment, FIG. 3 is an exploded perspective view of the male shielded connector of the embodiment, FIG. 4 is a perspective view of the female shielded connector, FIG. 5 is an exploded perspective view of the female shielded connector, FIG. 6 is a perspective view of a connector attaching portion of a case to which the female shielded connector and the female shielded connector are to be attached, and FIG. 7 is a perspective view of the male shielded connector which is connected to the female shielded connector.

As shown in FIG. 1, a shield connecting portion 10 is configured by connecting a male shielded connector 12 to a female shielded connector 13 which is fixed to a case 11.

First, the structure of the male shielded connector 12 of the embodiment will be described.

As shown in FIGS. 2 and 3, the male shielded connector 12 includes a housing 21, a shield shell 22, electric wires 23, a braided conductor 24, and a shield ring 25.

The housing 21 functions as a male connector housing, and is integrally molded with an insulative resin. In the housing 21, a plurality of connecting projections 30 which are projected toward the tip end side that is the connection side to the female shielded connector 13 are formed in parallel. A plurality of cavities 31 which longitudinally penetrate through the housing 21 are formed in the connecting projections 30, respectively. Terminals 32 which are connected to end portions of the wires 23 are inserted and contained in the cavities 31 from the rear end side which is opposite to the connection side to the female shielded connector 13, respectively.

Each of the wires 23 has a structure where a conductor is covered by an insulative resin, and is fixed in a state where the wire is electrically conductive with the conductor, by crimping the terminal 32 to the end portion of the wire 23.

Rubber plugs 33 and holding members 34 are attached to the wires 23 in the sequence starting from the side of the terminal 32, while being pressed into the cavities 31 from the rear end side of the housing 21, respectively. In the cavities 31, therefore, the side of the rear end of the housing 21 is sealed by the rubber plugs 33 held by the holding members 34.

In the housing 21, a flange portion 35 which is projected toward the outer periphery is formed in the longitudinal middle of the housing. In the flange portion 35, a fitting recess 36 is formed on the side of the tip end of the housing 21. A packing 47 which is annularly formed is attached to the housing 21 from the rear end side.

The shield shell 22 is formed by a steel plate such as SPC which is an electrically conductive metal material, and tin plating is applied to the outer circumferential surface. The shield shell 22 has a shell main unit 41 which is formed into a bottomed cylindrical shape. Through holes 43 through which the wires 23 are respectively passed are formed in a bottom portion 42 of the main unit 41 (see FIG. 1). The shield shell 22 further has a fixing flange portion 44 which is circumferentially projected, in the shell main unit 41 and on the side of the housing 21. The fixing flange portion 44 has fixing pieces 45 which are projected respectively toward the both sides of the shield shell 22. Through holes 46 are formed in the fixing pieces 45, respectively.

Then, the rear end side of the housing 21 is fittingly attached to the shell main unit 41 of the shield shell 22. At this time, the packing 47 is clamped between the flange portion 35 of the housing 21 and the fixing flange portion 44 of the shield shell 22. This clamping causes the housing 21 and the shield shell 22 to be sealed.

The braided conductor 24 is formed into a cylindrical shape by cross-braiding a plurality of braiding wires made of copper or copper alloy to which tin plating is applied. When the braided conductor is electrically connected to the shield shell 22, a grounding circuit for preventing a disturbance or the like from occurring in electric signals passing through the wires 23 is formed. Usually, the braided conductor 24 is covered on the plurality of wires 23 so as to cover the circumference of the wires. An end portion of the braided conductor 24 is widened, and covered on the shell main unit 41 of the shield shell 22 from the rear end side of the main unit.

The shield ring 25 is made of a stainless steel plate such as SUS which is a metal material having high strength, and formed into an annular shape. The shield ring 25 is swaged in a state where the shield ring is attached to the outer circumferential side of the braided conductor 24 which is covered on the shell main unit 41 of the shield shell 22. This causes the braided conductor 24 to be fixed in a state where the braided conductor is electrically connected to the shell main unit 41 of the shield shell 22.

In the embodiment, an insulation layer 51 is disposed between the braided conductor 24 and the shield ring 25. According to the configuration, the braided conductor 24 and the shield ring 25 are prevented from being contacted with each other, and therefore insulated from each other. Specifically, an acetate tape formed of semisynthetic fibers which are made of acetylcellulose is wound around the outer circumference of the braided conductor 24 covered on the shell main unit 41 of the shield shell 22, and the shield ring 25 is swaged. According to the configuration, the insulation layer 51 which is formed by an acetate tape is disposed between the braided conductor 24 and the shield ring 25, and the braided conductor 24 and the shield ring 25 are insulated from each other.

Next, the structure of the female shielded connector 13 to which the male shielded connector 12 of the embodiment is to be connected will be described.

As shown in FIGS. 4 and 5, the female shielded connector 13 is to be attached to the case 11 of an apparatus, and includes a housing 61 and terminals 62.

The housing 61 functions as a female connector housing, and is integrally molded with an insulative resin. In the housing 61, a plurality of cavities 65 which longitudinally penetrate through the housing are formed in parallel. In the cavities 65, the tip end sides to which the male shielded connector 12 is to be connected are formed as connecting openings 66. The connecting projections 30 of the male shielded connector 12 are fitted into the connecting openings 66, respectively.

Terminals 62 are inserted and contained in the cavities 65 from the rear end side of the housing 61. Electric wires (not shown) from electric and electronic components in the apparatus are connected and conducted with the terminals 62. O-rings 70 are attached to the terminals 62 from the side of the connecting openings 66, respectively, and the spaces between the cavities 65 and the terminals 62 are sealed.

In the housing 61, a flange portion 67 which is projected toward the surrounding area is formed in the vicinity of the tip end side. The flange portion 67 has fixing pieces 68 which are projected to the both side portions of the housing 61, respectively. Through holes 69 are formed in the fixing pieces 68, respectively.

Packings 71, 72 are attached from the tip and rear end sides to the housing 61, respectively.

In the case 11 to which the female shielded connector 13 is to be fixed, as shown in FIG. 6, a connector attaching portion 81 is disposed on the outer surface. An attaching hole 82 into which the rear end side of the housing 61 of the female shielded connector 13 is to be inserted is formed in the connector attaching portion 81. A recess 83 is formed in the outer surface of the case 11 so as to extend along the peripheral edge of the attaching hole 82. The flange portion 67 which is formed on the housing 61 of the female shielded connector 13 is fitted into the recess 83. In a bottom portion of the recess 83 of the case 11, screw holes 84 are formed at positions which communicate with the through holes 69 of the fixing pieces 68 of the flange portion 67 that is fitted. In the outer surface of the case 11, screw holes 85 are formed also in the vicinity of the recess 83.

When the female shielded connector 13 is to be attached to the case 11, the rear end side of the housing 61 of the female shielded connector 13 is inserted into the attaching hole 82, and the flange portion 67 is fitted into the recess 83. In this state, fixing screws 91 are inserted into the through holes 69 formed in the fixing pieces 68 of the flange portion 67, and screwed into the screw holes 84. Therefore, the female shielded connector 13 is fixed and attached to the case 11 (see FIG. 1). When the female shielded connector 13 is fixed to the case 11 in this way, the packing 71 is clamped by the bottom portion of the recess 83 of the case 11 and the flange portion 67 of the housing 61, and therefore the space between the case 11 and the female shielded connector 13 is sealed.

When the male shielded connector 12 is to be connected to the female shielded connector 13 which is attached to the case 11 in this way, the connecting projections 30 formed in the housing 21 of the male shielded connector 12 are approximated to the connecting openings 66 formed in the housing 61 of the female shielded connector 13, while being fitted into the connecting openings. As a result, the tip end portion of the housing 21 of the female shielded connector 13 is fitted into the fitting recess 36 formed in the housing 21 of the male shielded connector 12.

In this state, as shown in FIG. 7, fixing screws 92 are inserted into the through holes 46 formed in the fixing pieces 45 of the fixing flange portion 44 of the shield shell 22 of the male shielded connector 12, and screwed into the screw holes 85, respectively. Therefore, the male shielded connector 12 is attracted toward the case 11 to be fastened and fixed thereto, and the male shielded connector 12 and the female shielded connector 13 are connected to each other.

Then, the terminals 32, 62 of the male shielded connector 12 and the female shielded connector 13 are connected to and electrically conductive with each other. The packing 71 is clamped by the flange portions 35, 67 of the housing 21 of the male shielded connector 12 and the housing 61 of the female shielded connector 13, and therefore the space between the male shielded connector 12 and the female shielded connector 13 is sealed.

Moreover, the shield shell 22 of the male shielded connector 12 is closely contacted with the outer surface of the case 11 by the fixing screws 92, whereby the braided conductor 24 is electrically connected to the case 11 through the shield shell 22 to form the grounding circuit, and a disturbance or the like is surely prevented from occurring in electric signals passing through the wires 23 and the connecting portions between the terminals 32, 62.

As described above, the braided conductor 24 is formed by cross-braiding a plurality of braiding wires made of copper or copper alloy to which tin plating is applied, and, by contrast, the shield ring 25 is formed by a stainless steel plate such as SUS.

Figure 8:
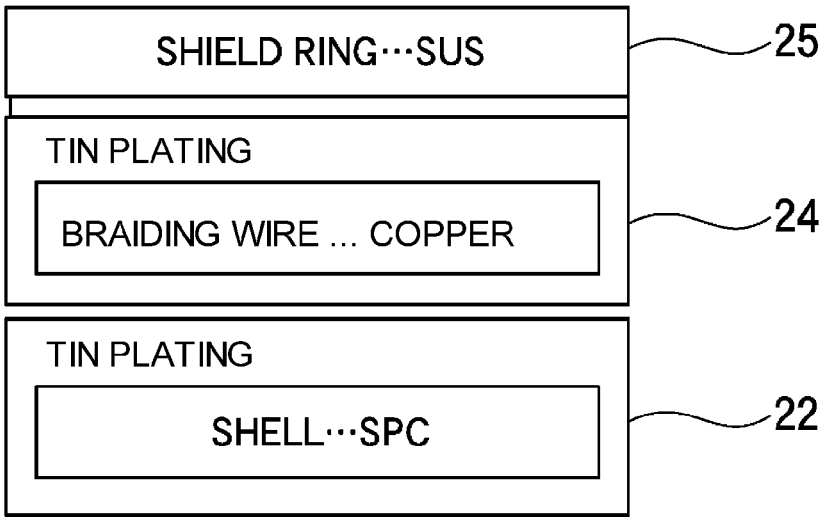
FIG. 8 is a diagram showing a sectional structure of a portion where a shield ring is swaged to a usual male shielded connector.

When the shield ring 25 is directly attached to the outer circumferential side of the braided conductor 24 and then swaged, therefore, the portion where the braided conductor 24 made of copper or copper alloy to which tin plating is applied is in contact with the shield ring 25 made of a stainless steel plate has a bimetallic contact as shown in FIG. 8, and there is a possibility that galvanic corrosion may occur to reduce the shielding effect.

Figure 9:
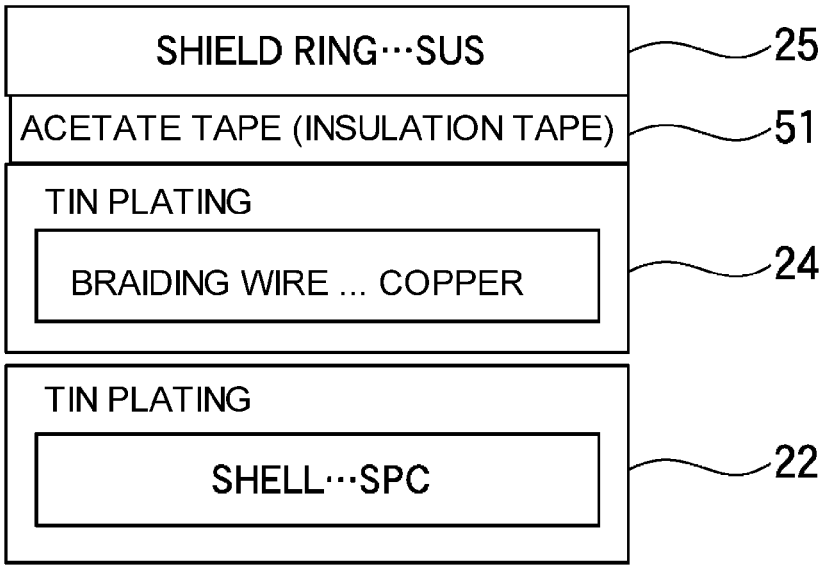
FIG. 9 is a diagram showing a sectional structure of a portion where a shield ring is swaged to the male shielded connector of the embodiment.

In the embodiment, by contrast, the shield ring 25 is attached and swaged to the outer circumferential side of the braided conductor 24 through the insulation layer 51, and therefore a state is attained where, as shown in FIG. 9, the braided conductor 24 made of copper or copper alloy to which tin plating is applied, and the shield ring 25 made of a stainless steel plate are insulated from each other by the insulation layer 51. Therefore, it is possible to surely prevent galvanic corrosion due to a bimetallic contact from occurring in the place where the shield ring 25 is swaged. Consequently, an excellent shielding effect can be always maintained, and high performance and quality can be maintained for a long period.

The acetate tape formed of semisynthetic fibers which are made of acetylcellulose is wound around the outer circumference of the braided conductor 24 covered on the shield shell 22, and the shield ring 25 is swaged from the outer circumferential side thereof, whereby the braided conductor 24 and the shield ring 25 can be satisfactorily insulated from each other in a very easy manner.

The invention is not limited to the above-described embodiment, and may be adequately subjected to modifications, improvements, and the like. In addition, the materials, shapes, dimensions, numbers, places, and the like of the components of the above-described embodiment are arbitrary and not limited insofar as the invention is achieved.

Although the invention has been described in detail and with reference to the specific embodiment, it is obvious to those skilled in the art that various changes and modifications can be made without departing from the spirit and scope of the invention.

In the shielded connector of the invention, an excellent shielding effect can be always maintained. Therefore, the shielded connector is useful.

What is claimed is:

1. A shielded connector comprising:

a terminal which is connected to an end portion of an electric wire;

a housing which contains the terminal;

a shield shell which covers the housing;

a braided conductor which is externally provided to the wire and is covered on the shield shell; and a shield ring which is swaged to an outer circumference of the braided conductor to fix the braided conductor in a state that the braided conductor is electrically connected to the shield shell, the shield ring being made of a metal material, wherein an insulation layer is provided between the braided conductor and the shield ring; and wherein the insulation layer is configured by an acetate tape formed of semisynthetic fibers which are made of acetylcellulose.

* * * * *